US006932106B1

(12) United States Patent
Wang

(10) Patent No.: US 6,932,106 B1
(45) Date of Patent: Aug. 23, 2005

(54) HOSE REEL

(76) Inventor: King-Yuan Wang, P.O. Box 487, Chang-Hua City 500 (TW)

( * ) Notice: Subject to any disclaimer, the term of this patent is extended or adjusted under 35 U.S.C. 154(b) by 0 days.

(21) Appl. No.: 10/991,393

(22) Filed: Nov. 19, 2004

(51) Int. Cl.[7] ..... B65H 75/34
(52) U.S. Cl. ..... 137/355.27; 137/355.26; 137/580
(58) Field of Search ..... 137/580, 355.26, 137/355.27

(56) References Cited

U.S. PATENT DOCUMENTS 4,512,361 A * 4/1985 Tisbo et al. ..... 137/355.27
4,768,546 A * 9/1988 Brusadin et al. ..... 137/355.27
5,657,789 A * 8/1997 Tisbo et al. ..... 137/355.27
5,758,685 A * 6/1998 Tisbo et al. ..... 137/355.27

* cited by examiner

*Primary Examiner*—A. Michael Chambers

(57) ABSTRACT

A hose reel includes a base with two side panels and a mandrel is rotatably connected between the two side panels. Two side boards are connected to two ends of the mandrel and one of which is connected to a handle and the other side board receives a first end of a connection tube. The connection tube has hooks so as to be engaged with extensions at the opening of the side panel. By this way, the connection tube is secured to the side panel without adhesive. A cap with curve and smooth outside is mounted to a second end of the connection tube.

4 Claims, 4 Drawing Sheets

HOSE REEL

FIELD OF THE INVENTION

The present invention relates to a hose reel whose parts are connected with each other without using adhesive.

BACKGROUND OF THE INVENTION

A conventional hose reel is disclosed in FIG. 4 and generally includes a base 10 with two side panels 21, 22 and a hollow mandrel 20 is connected between the two side panels 21, 22. A plurality of separation bars 12 are connected between the two side panels 11 to fix the distance between the two panels 11. The mandrel 20 includes two flanges 201 on two ends thereof and a first disk 21 and a second disk 22 are respectively connected to the two ends of the mandrel 20. The first disk 21 has a connection tube 211 which extends through a through hole 111 defined through one of the two side panels 11 and a handle 23 is securely connected to the connection tube 211. The handle 23 includes an insertion 232 which has a plurality of ridges 233 defined axially in an outer surface thereof and adhesive (not shown) is applied to the contact area of the ridges 233 and grooves (not shown) in the connection tube 211 to fixedly connect the handle 23 to the connection tube 211. A user may hold the handlebar 231 on the handle 23 and rotate the mandrel 20 to retrieve hose (not shown). The second disk 22 includes an elbow piece 221 on a first side thereof and the elbow piece 221 is inserted through an aperture 202 in the mandrel 20. A fitting 2211 extends from the elbow piece 221 so as to be connected with the hose. An inlet tube 222 extends from a second side of the second disk 22 and includes a groove 223 and a seal 224 is mounted onto the inlet tube 222. The inlet tube 222 extends through another through hole 111 in the other side panel 11 and an engaging groove 1112 is defined in an inner periphery of the through hole 111. A connection member 24 has one end engaged with the through hole 111 and includes a protrusion 241 which is engage with the engaging groove 1112. Two snap pieces 242 extend from an inner periphery of the connection member 24 and are engaged with the groove 223 of the inlet tube 222. The connection member 24 is used to be connected to a section of hose (not shown) which is to be connected to a faucet. It is noted that the separation bars 12 are connected between the two side panels 11 by adhesive. This takes a lot of labor time to assemble the hose reel. Besides, the connection member 24 extends out from the outside of the side panel 11 for a length and the connection member 24 requires extra protection arrangement when in packing and transportation.

The present invention intends to provide a hose reel wherein all the parts are easily connected with each other with using adhesive and the hose reel can be easily assembled within a short period of time.

SUMMARY OF THE INVENTION

The present invention relates to a hose reel which comprises a base with two side panels on two sides thereof and each side panel has a through hole. An opening is defined in an outer side of one of the two side panels and extensions extend inward from a periphery of the opening. A mandrel is connected between the two side panels and has an aperture defined radially therethrough. A first side board and a second side board each have a tube which extends through respective one of the two through holes of the two side panels. The first side board has an elbow member which extends into an end of the mandrel and is located at the aperture of the mandrel. A handle is engaged with an opening of the second side board. An engaging portion is defined on the first side board and oppose to the tube. The through hole of the side panel that is connected to the first side board has an engaging shoulder in the through hole so that the engaging portion is engaged with the engaging shoulder. A connection tube has a first end inserted into the tube of the first side board and a plurality of hooks are formed on the first end of the connection tube. An enlarged portion is defined in an end of each of the hooks so as to be engaged with the extensions of the opening of the side panel.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
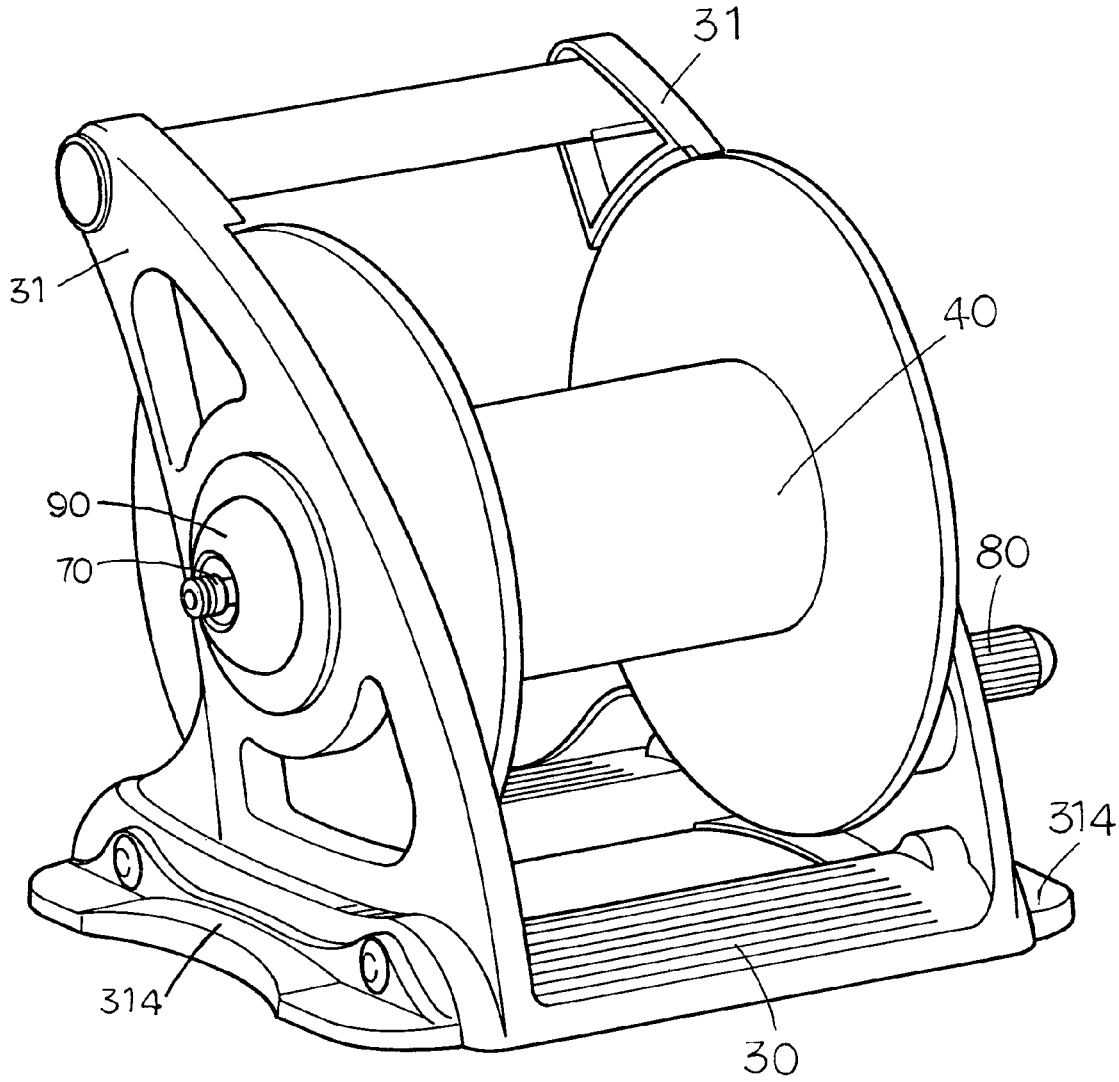
FIG. 1 shows a perspective view of the hose reel of the present invention.
Figure 2:
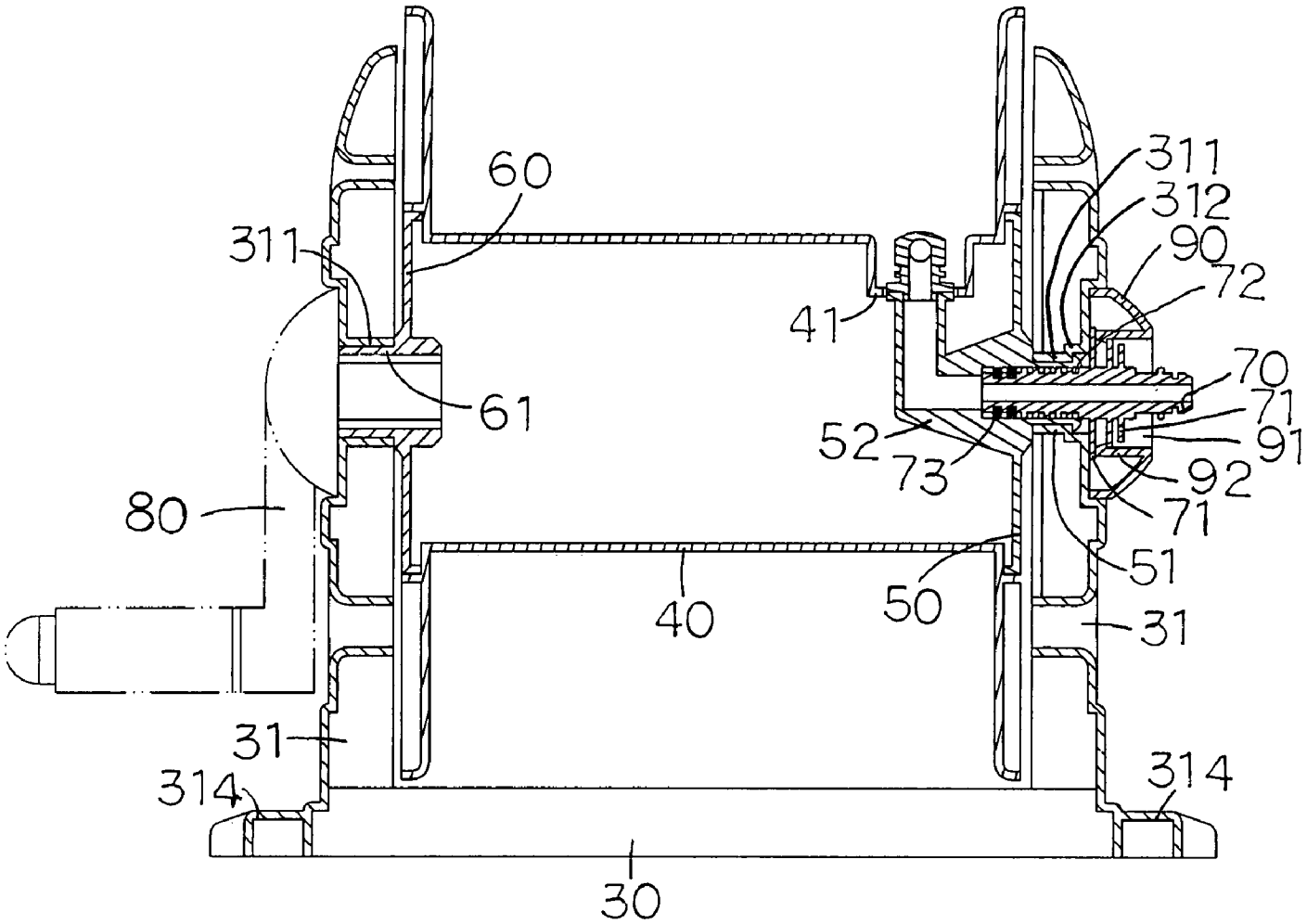
FIG. 2 is a cross sectional view of the hose reel of the present invention.
Figure 3:
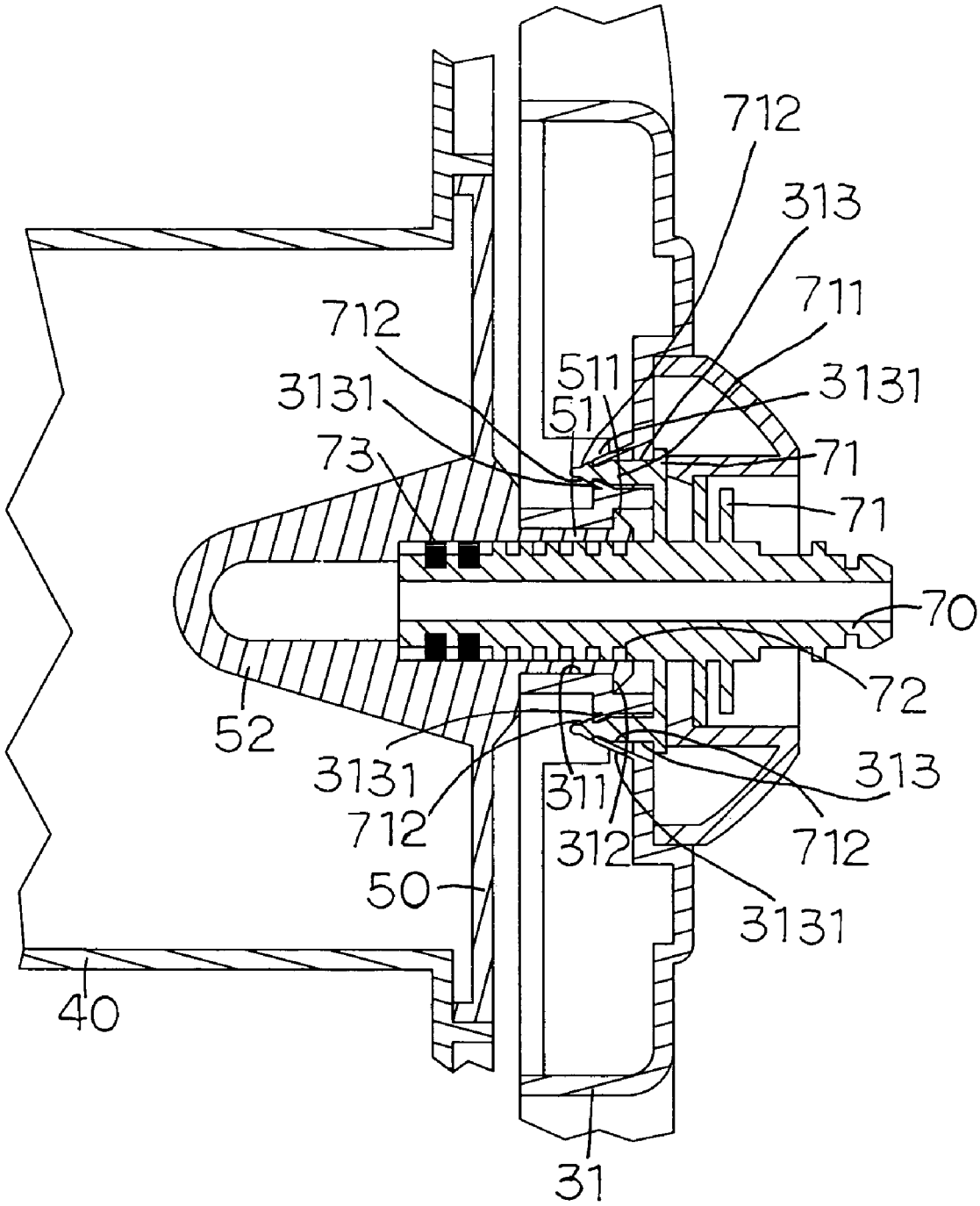
FIG. 3 is an enlarged cross sectional view of the hose reel of the present invention.
Figure 4:
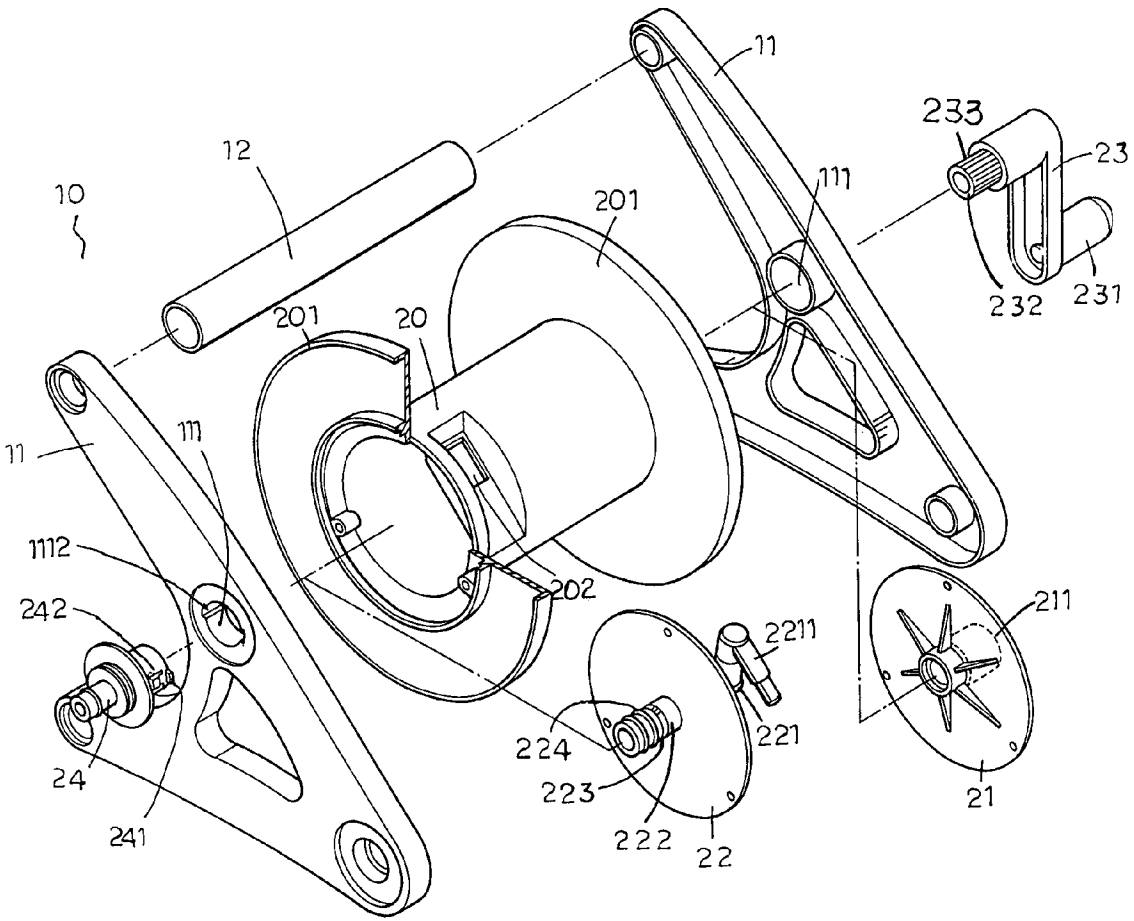
FIG 4 PRIOR ART
FIG. 4 is an exploded view to show a conventional hose reel of the present invention.

Referring to FIGS. 1 to 3, the hose reel of the present invention comprises a base 30 with two side panels 31 on two sides thereof and each side panel 31 has a through hole 311. An opening 313 is defined in an outer side of one of the two side panels 31 and extensions 3131 extend inward from a periphery of the opening 313.

A hollow mandrel 40 is rotatably connected between the two side panels 31 and has an aperture 41 defined radially therethrough. A first side board 50 is connected between one end of the mandrel 40 and one of the two side panels 31, and a second side board 60 is connected between the other end of the mandrel 40 and the other side panel 31. Each of the first and second side boards 50, 60 has a tube 51/61 which extends through respective one of the two through holes 311 of the two side panels 31. The first side board 50 has an elbow member 52 which extends into one of two open ends of the mandrel 40 and is located at the aperture 41 of the mandrel 40. A handle 80 is engaged with an opening 61 of the second side board 60 so that when rotating the handle 80, the mandrel 40 rotates too.

An engaging portion 511 is provided on the first side board 50 and oppose to the tube 51. The through hole 311 of the side panel 31 that is connected to the first side board 50 has an engaging shoulder 312 in the through hole 311 so that the engaging portion 511 is engaged with the engaging shoulder 312 to fix the first side board 50.

A connection tube 70 has a first end inserted into the tube 51 of the first side board 50 and a plurality of hooks 711 are formed on the first end of the connection tube 70. An enlarged portion 712 is defined in an end of each of the hooks 711 so as to be engaged with the extensions 3131 of the opening 313 of the side panel 31. A plurality of groove 72 are defined in an outer periphery of the first end of the connection tube 70 and seals 73 are engaged with the grooves 72 so as to prevent leakage.

A cap 90 having curve and smooth outside is mounted to a second end of the connection tube 70 and a stop 92 extends inward from an inner periphery of the cap 90. The stop 92 is engaged with one of rings 71 extending from the connection tube 70. The cap 90 makes the side profile of the hose reel to be smooth and neat. Two extension boards 314 are connected to two lower ends of the base 30 such that the user may step on the extension board 314 to operate the handle 80 to retrieve the hose to the mandrel 40.

It is noted that there needs no adhesive during assembly processes of the hose reel and the cap 90 is advantageous for packing and does not penetrate the packing material during transportation.

While we have shown and described the embodiment in accordance with the present invention, it should be clear to those skilled in the art that further embodiments may be made without departing from the scope of the present invention.

What is claimed is:

1. A hose reel comprising:

a base (30) with two side panels (31) on two sides thereof and each side panel (31) having a through hole (311), an opening (313) defined in an outer side of one of the two side panels (31) and extensions (3131) extending inward from a periphery of the opening (313);

a mandrel (40) connected between the two side panels (31) and having an aperture (41) defined radially therethrough, a first side board (50) and a second side board (60) each having a tube (51/61) which extends through respective one of the two through holes (311) of the two side panels (31), the first side board (50) having an elbow member (52) which extends into an end of the mandrel (40) and is located at the aperture (41) of the mandrel (40), a handle (80) engaged with an opening (61) of the second side board (60), an engaging portion (511) provided on the first side board (50) and oppose to the tube (51), the through hole (311) of the side panel (31) that is connected to the first side board (50) having an engaging shoulder (312) in the through hole (311) so that the engaging portion (511) is engaged with the engaging shoulder (312), and a connection tube (70) having a first end inserted into the tube (51) of the first side board (50) and a plurality of hooks (711) formed on the first end of the connection tube (70), an enlarged portion (712) defined in an end of each of the hooks (711) so as to be engaged with the extensions (3131) of the opening (313) of the side panel (31).

2. The hose reel as claimed in claim 1, wherein a cap (90) is mounted to a second end of the connection tube (70) and a stop (92) extends inward from an inner periphery of the cap (90), the stop (92) engaged with one of rings (71) extending from the connection tube (70).

3. The hose reel as claimed in claim 1, wherein two extension boards (314) are connected to two lower ends of the base (30).

4. The hose reel as claimed in claim 1, wherein a plurality of groove (72) are defined in an outer periphery of the first end of the connection tube (70) and seals (73) are engaged with the grooves (72).

* * * * *